US005950835A

United States Patent [19]

Moser et al.

[11] Patent Number: 5,950,835

[45] **Date of Patent: *Sep. 14, 1999**

[54] HONEYCOMB PROTECTOR WITH IMPACT RESISTANT CORNER

[75] Inventors: Paul Moser, Milford, Conn.; Robert E. Jaegers, Lake Zurich; Raymond A. Kowalski, Mundelien, both of Ill.

[73] Assignee: Tenneco Packaging Inc., Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,658

[22] Filed: Dec. 24, 1996

[51] Int. Cl.[6] ..... B65D 81/02

[52] U.S. Cl. ..... 206/586

[58] Field of Search ..... 206/586, 591, 206/521, 594, 592, 814; 248/345.1

[56] References Cited

U.S. PATENT DOCUMENTS

| | | | |
|---|---|---|---|
| 2,006,224 | 6/1935 | Weber et al. . | |
| 2,704,587 | 3/1955 | Pajak . | |
| 2,728,479 | 12/1955 | Wheeler . | |
| 3,179,023 | 4/1965 | Hoff . | |
| 3,220,683 | 11/1965 | Doll . | |
| 3,349,984 | 10/1967 | Halko . | |
| 3,481,813 | 12/1969 | Wiggers . | |
| 3,587,479 | 6/1971 | Geschwender . | |
| 3,655,112 | 4/1972 | Jeffers . | |
| 3,655,478 | 4/1972 | Geschwender . | |
| 3,746,593 | 7/1973 | Majewski et al. . | |
| 3,843,038 | 10/1974 | Sax . | |
| 3,866,523 | 2/1975 | Geschwender . | |
| 3,890,108 | 6/1975 | Welsh . | |
| 3,900,156 | 8/1975 | Clark, Jr. . | |
| 3,955,677 | 5/1976 | Collingwood . | |
| 4,388,134 | 6/1983 | Long et al. . | |
| 4,496,054 | 1/1985 | Koltun . | |
| 4,529,091 | 7/1985 | Martin | 206/586 |
| 4,596,541 | 6/1986 | Ward, Sr. et al. . | |
| 4,883,179 | 11/1989 | Dionne . | |
| 5,175,041 | 12/1992 | Webb et al. . | |
| 5,466,211 | 11/1995 | Komarek et al. . | |
| 5,511,667 | 4/1996 | Carder . | |
| 5,533,956 | 7/1996 | Komarek et al. . | |
| 5,680,934 | 10/1997 | Jaegers et al. | 206/586 |

FOREIGN PATENT DOCUMENTS

| | | |
|---|---|---|
| 2 690 870-A1 | 5/1992 | France . |

*Primary Examiner*—Paul T. Sewell
*Assistant Examiner*—Nhan T. Lam
*Attorney, Agent, or Firm*—Arnold, White & Durkee

[57] ABSTRACT

A honeycomb protector for protecting the corners and edges of articles during shipping comprising a honeycomb panel foldable between a flat position and a folded position. The panel includes a honeycomb core sandwiched between top and bottom face sheets. The top face sheet includes a slitted segment defining a hinge about which the panel can be folded. In the folded position, the panel includes an impact absorbing corner comprising a region of the panel where the partition walls of the honeycomb core converge towards the top face sheet and the hollow-cell faces of the core abutting the top face sheet are laterally flattened and compressed.

39 Claims, 7 Drawing Sheets

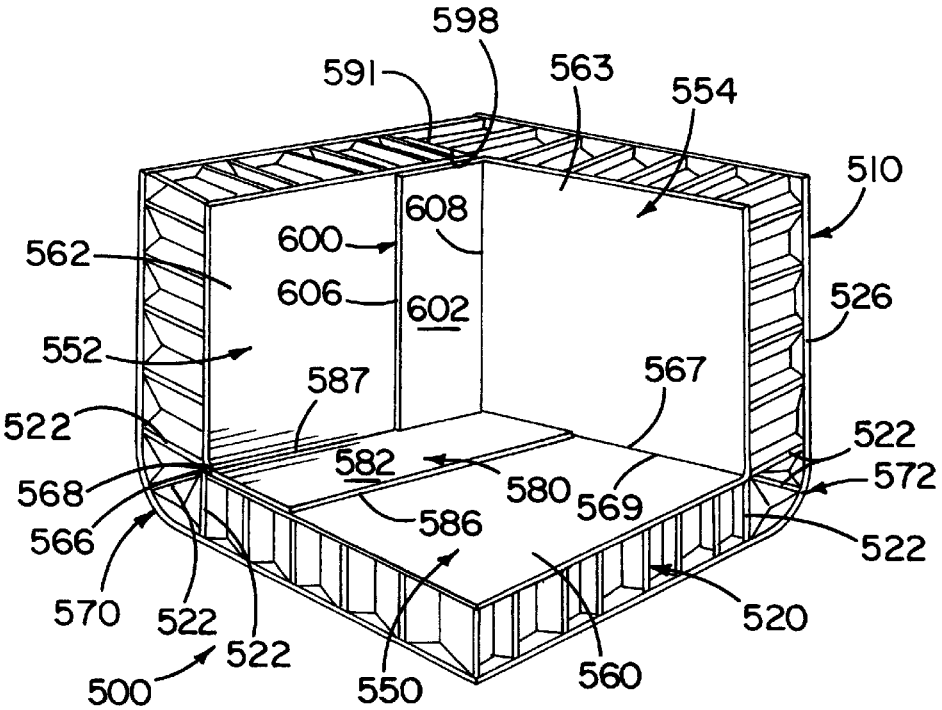
FIG. 9
FIG. 10
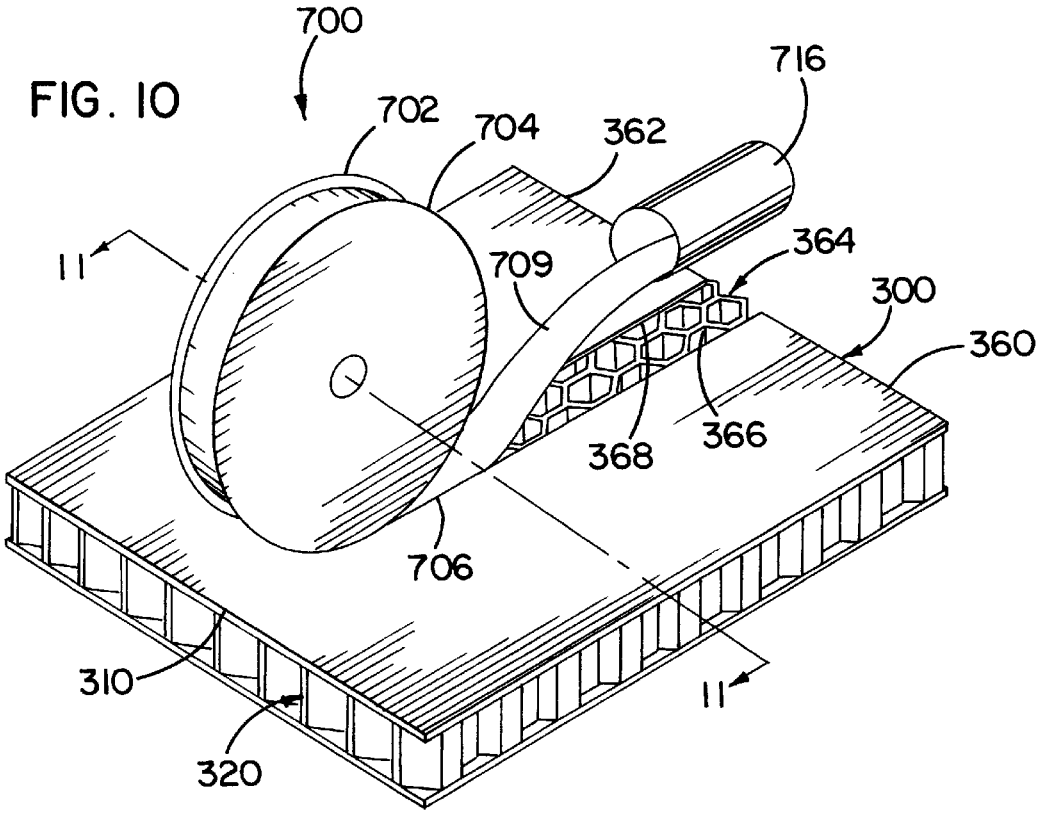

HONEYCOMB PROTECTOR WITH IMPACT RESISTANT CORNER

TECHNICAL FIELD

This invention relates generally to a protector for an article to be packaged and, more particularly, to a honeycomb protector including an impact resistant corner.

BACKGROUND OF THE INVENTION

For many years, protectors have been secured to the edges, corners and other surfaces of manufactured articles such as appliances, electronic articles and doors to protect the edges, corners and other surfaces of such articles from damage during handling and shipment.

A type of edge and corner protector assembly currently in use comprises a panel including a paper honeycomb core disposed between face sheets. The panel is supplied to the manufacturer of the articles to be packaged in flat form. The panel is folded by the manufacturer along crush scores or the like formed in the honeycomb core, then taped, glued, stapled, or otherwise coupled together so that the protector remains folded and is then applied to the edges or corners of the articles to be shipped.

A problem associated with this corner protector is that the honeycomb core is crushed or slitted to form the fold lines about which the panel is folded. The crushing and slitting of the core can weaken the honeycomb core and protector structure in the region of the corner of such protector thus increasing the likelihood of damage to the article being shipped from a direct impact at the edge or corner of the protector.

Published French Patent Application No. 2-690-870 to SociétéAnonyme dite RLG Concepts discloses another type of edge and corner protector comprising a panel (FIGS. 3 and 4) including a paper honeycomb core disposed between face sheets which is supplied to the manufacturer of the articles to be folded in its folded form. Although the honeycomb core in the corner is not crushed or slitted, the disadvantage of this corner protector is that it must be manufactured, supplied and sold in its folded form.

The manufacture of this corner protector requires the design of expensive, custom machinery that will need to first fold the honeycomb core and then apply folded face sheets to the top and bottom surfaces of the honeycomb core. Moreover, these corner protectors are more difficult to package and transport because they are supplied in their folded form.

The present invention solves these problems by providing a honeycomb protector that can be supplied to the manufacturer of the articles to be packaged in flat form. The protector includes fold lines that are formed without crushing or slitting the honeycomb core so as to provide a foldable honeycomb protector with an impact resistant corner where the honeycomb core has the same rigidity and strength characteristics as the honeycomb core in the other regions of the honeycomb protector.

SUMMARY OF THE INVENTION

The present invention is a honeycomb protector for protecting the corners, edges or other surfaces of articles during shipping which comprises a panel including a honeycomb core having a plurality of abutting cells defining a plurality of abutting top and bottom hollow cell faces respectively. A bottom face sheet is secured over and abutting the bottom hollow cell faces of the honeycomb core and a top face sheet is secured over and abutting the top hollow cell faces of the honeycomb core. The top face sheet includes a slitted segment defining a hinge about which the panel is folded. The panel defines a corner portion when the panel is folded where the partition walls of the honeycomb core converge towards each other in the direction of the top face sheet and the top hollow cell faces of the honeycomb core are laterally compressed.

In a first preferred embodiment, the slitted segment of the top face sheet is defined by first and second spaced-apart top face sheets secured over and abutting the plurality of top hollow cell faces of the honeycomb core. The first and second top face sheets are spaced from each other when the panel is in a flat position so as to expose a segment of the honeycomb core and the top hollow cell faces of the honeycomb core. The exposed segment of honeycomb core is located between the first and second top face sheets and defines a hinge about which the panel is folded.

Each of the first and second top face sheets includes an inner elongate peripheral edge spaced such that, when the panel is folded, the peripheral edges of the first and second top face sheets abut each other and the partition walls of the exposed core segment converge towards each other in the direction of the first and second top face sheets and the hollow cell faces of the core segment are laterally compressed. The width of the exposed core segment is preferably about 1.6 times the thickness of the honeycomb core.

Adhesive means can be applied to the hollow cell faces of the exposed core segment for securing the panel in a folded position. Alternatively, a strip of tape can be applied over the inner peripheral edges of the first and second top face sheets to secure the panel in the folded position.

The first protector embodiment can be made on an "in-line" apparatus where two spaced apart rotary slitters cut two spaced apart slits in the top face sheet of the honeycomb panel and the strip of the top face sheet which has been cut is separated from the panel so as to define a panel with first and second spaced-apart top face sheets.

In another preferred embodiment, the second top face sheet includes a flap unitary with the inner peripheral edge thereof which abuts and is secured to the top of the first top face sheet to secure the panel in the folded position. The flap includes adhesive means comprising a strip of double-sided tape or a strip of glue and preferably has a width approximately equal to 1.6 times the thickness of the honeycomb core.

This embodiment can be made in an in-line apparatus which applies a strip of tape to the inner surface of one of the face sheets prior to the face sheets being secured to the honeycomb core to form the honeycomb panel. A rotary slitter then cuts a slit through the face sheet and the tape and the slitted strip of the face sheet is then separated from the honeycomb core to form the flap.

In yet another embodiment, the slitted segment in the top face sheet is defined by a plurality of spaced-apart slits and the panel is foldable about the slitted segment. The width of the slitted segment is preferably about 1.6 times the thickness of the core.

Adhesive means may be applied to the surface of the slitted face sheet segment for securing the panel in the folded position.

This protector embodiment can be made on an in-line apparatus where a plurality of spaced and parallel rotary slitters cut a plurality of slits in the top face sheet of the honeycomb panel.

In all of the embodiments of the present invention, the fold lines are formed without crushing or slitting the honeycomb core and the corner of the protector defines a region of the panel where the partition walls of the honeycomb core converge towards each other and the inner hollow cell faces of the honeycomb core are compressed and flattened so as to provide a honeycomb protector with an impact resistant corner.

One advantage of each of the corner protector embodiments of the present invention is that they are supplied in a flat form thus making them easier to package and ship to the manufacturer of the articles to be protected.

Another advantage of each of the corner protector embodiments of the present invention is that they are manufactured in their flat form in standard "in-line" machinery and not the custom machinery required to make the corner protector disclosed in Published French Patent Application No. 2-690-870.

The flap on selected ones of the protector embodiments which includes adhesive allows a user to easily and quickly secure the protector in the folded position and dispenses with the need to tape, glue, or staple the protector in its folded position.

There are other advantages and features of the present invention which will be more readily apparent from the following detailed description of the preferred embodiments of the invention, the drawings, and the appended claims.

BRIEF DESCRIPTION OF THE DRAWINGS

In the accompanying drawings which form a portion of this disclosure:

FIG. 9 is a perspective view of the corner protector of FIG. 8 in its folded position;

FIG. 10 is a simplified, schematic perspective view of an apparatus for making a protector according to the present invention;

DESCRIPTION OF THE PREFERRED EMBODIMENTS

Figure 1:
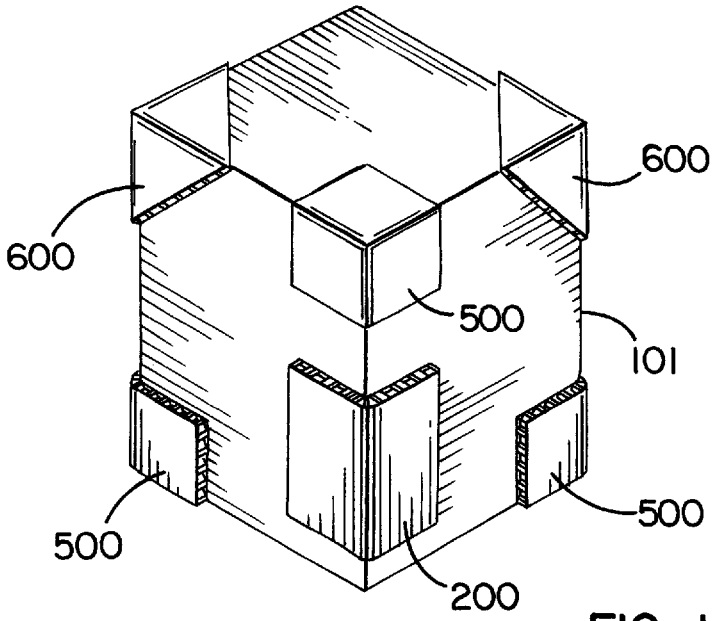
FIG. 1 is a perspective view of a box-like article with alternate embodiments of protectors constructed in accordance with the present invention positioned over its corners and edges.

An article 101 is shown in FIG. 1 with honeycomb protectors 200, 500 and 600 of the present invention positioned over its edges and corners for protecting the article 101 from damage during handling and shipping. The article 101 may be a manufactured good such as an appliance or electronic article such as a television.

Figure 2:
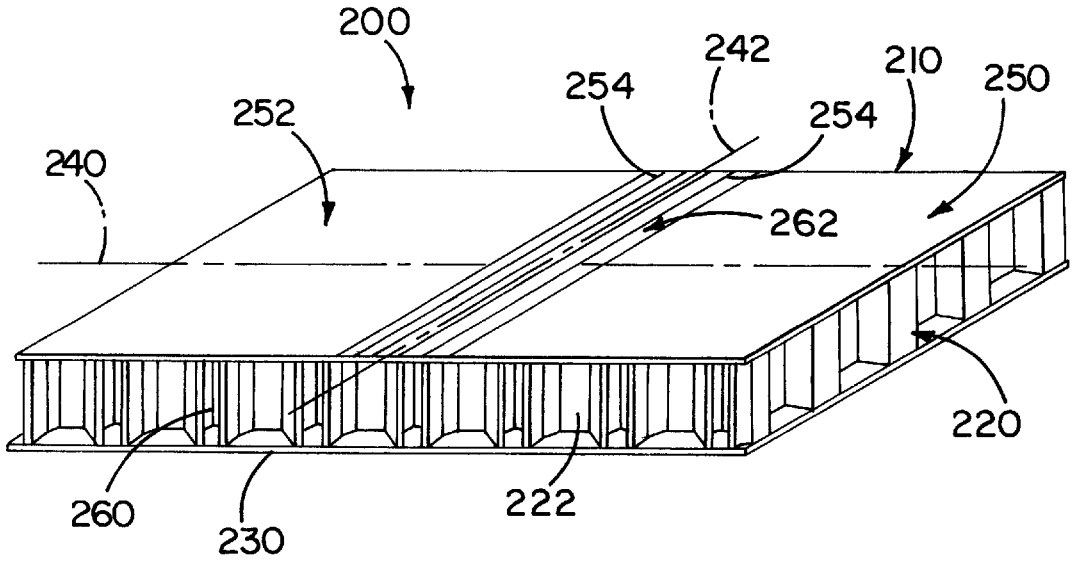
FIG. 2 is a perspective view of a first embodiment of a protector in its flat position.
Figure 3:
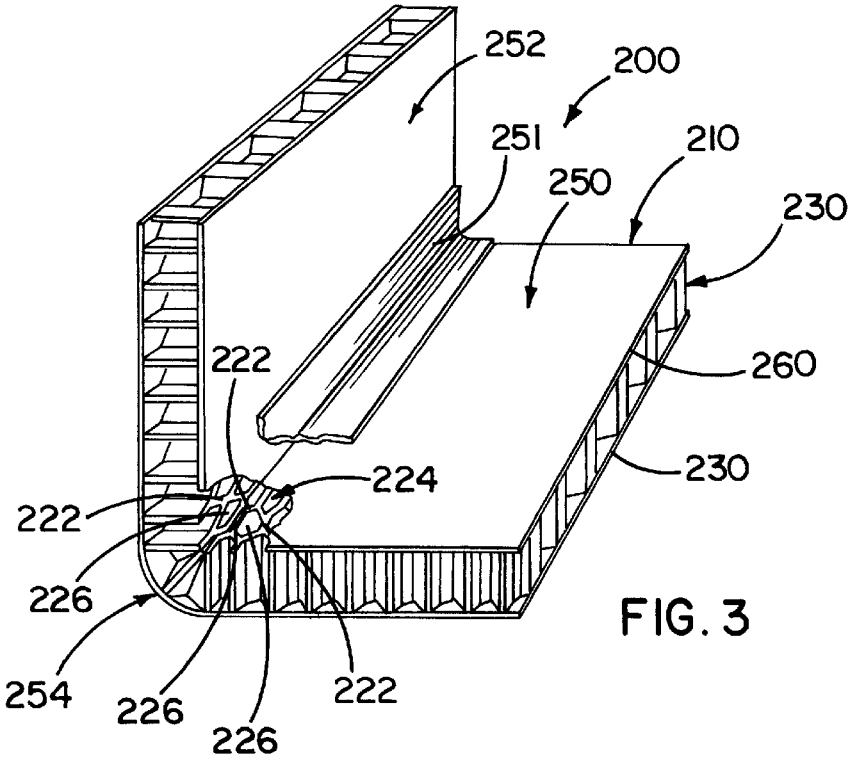
FIG. 3 is an perspective view of the protector of FIG. 2 in its folded position with a strip of tape secured to the interior corner thereof and a portion of the strip of tape and the top face sheet broken away in the interior corner region of the protector.

The edge protector 200 is depicted in FIGS. 2 and 3. Referring to FIG. 2, protector 200 comprises a generally rectangular panel 210 including a core 220 sandwiched between a bottom flat face sheet 230 and a top flat face sheet 260. The core 220 comprises a honeycomb core including a plurality of abutting partition walls 222 which extend generally perpendicularly between the bottom and top face sheets 230 and 260 respectively. The partition walls 222 form a plurality of abutting elongate hexagonal cells 224 having opposed bottom (not shown) and top hollow-cell hexagonal faces 226 (FIG. 3) on opposite sides of the core 220 respectively. The bottom and top face sheets 230 and 260 respectively are abutted against and adhesively secured to the bottom and top hollow-cell faces 226 of the core 220 respectively.

Preferably, the honeycomb core 220 and the bottom and top face sheets 230 and 260 respectively are made of a kraft paper. The face sheets 230 and 260 can be made of different weights of paper with 33 pound, 42 pound and 69 pound being preferred. Materials other than paper can also be used. In its flat position, the panel 210 preferably measures about 6×10 inches (about 15 by 25 cm) with a core thickness of about 1 inch (about 2.5 cm). Although the above dimensions are preferable for most applications, they are not limiting. It is also understood that the invention is not limited to rectangularly shaped protectors and is applicable to any other appropriately shaped protectors such as the triangularly shaped corner protector 600 depicted in FIG. 1.

The panel 210 includes a central longitudinal axis 240 and a central transverse axis 242. The top face sheet 260 includes a wide central slitted segment 262 defined by a plurality of spaced-apart and parallel slits 254 extending the width of the panel 210 parallel to and on opposite sides of the central transverse axis 242. Slitted face sheet segment 262 preferably has a width which is about 1.6 times the width of the core 220 when the panel is to be folded perpendicularly. The panel can also be folded at other angles with the width of the segment being adjusted accordingly.

Segment 262 divides the panel 210 into opposing first and second panel portions 250 and 252. The slits 254 in segment 262 create lines of weakening in the top face sheet 260 which allow the panel 210 to be folded about the segment 262 and the transverse axis 242.

Protector 200 is folded by the manufacturer of the articles to be protected by rotating the first and second panel portions 250 and 252 of panel 210 upwardly and inwardly towards each other about the central slitted segment 262 and the transverse axis 242 until the first and second panel portions 250 and 252 are disposed generally perpendicularly to each other.

In its folded position (FIG. 3), the protector 200 includes an elongate impact resistant and absorbing corner 254 between and unitary with the first and second panel portions 250 and 252. The corner 254 defines a portion of the protector 200 where the partition walls 222 of the core 220 underlying the slitted segment 262 converge towards each other in the direction of the top face sheet 260. In particular, the top peripheral portions of the partition walls 222 are compressed towards each other and the top-hollow cell hexagonal faces 226 of the core 220 are laterally flattened and compressed.

Adhesive strip means such as a strip of single-sided tape 251 can be applied to the interior surface of the corner 254 after the panel 210 has been folded to hold the panel 210 in the folded position. Alternatively, and although not shown, the protector 200 may be held in its folded position by applying an adhesive over the surface of the central slitted segment 262 just prior to folding the panel 210. The protector can also be shipped to the end user with adhesive means already in place. Suitable adhesive means for this process include dry or water-based contact adhesives.

Figure 4:
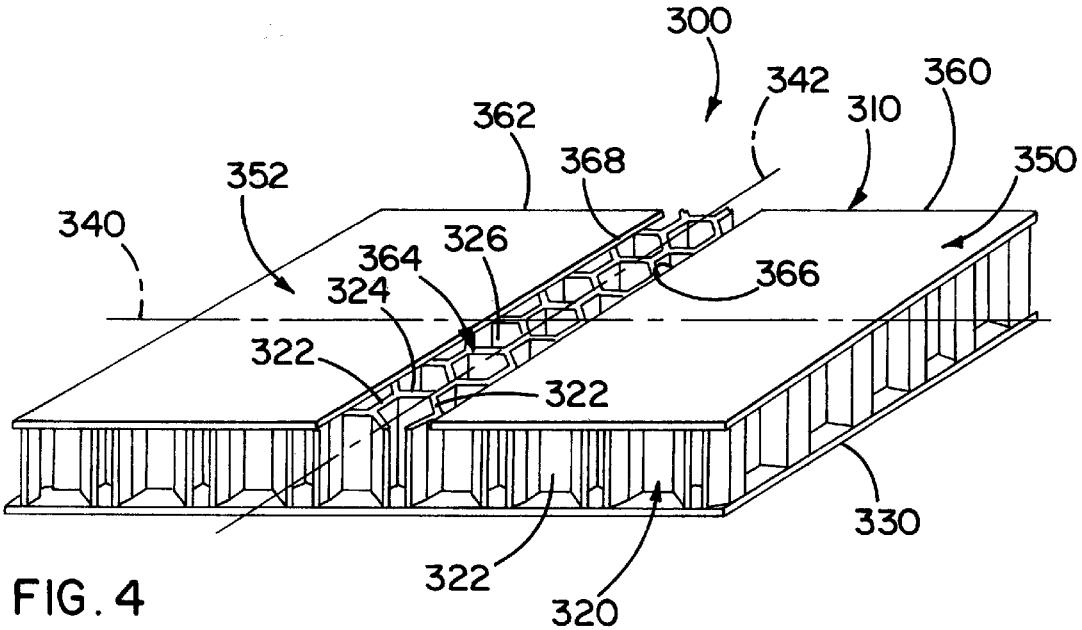
FIG. 4 is a perspective view of a second embodiment of a protector in its flat position.
Figure 5:
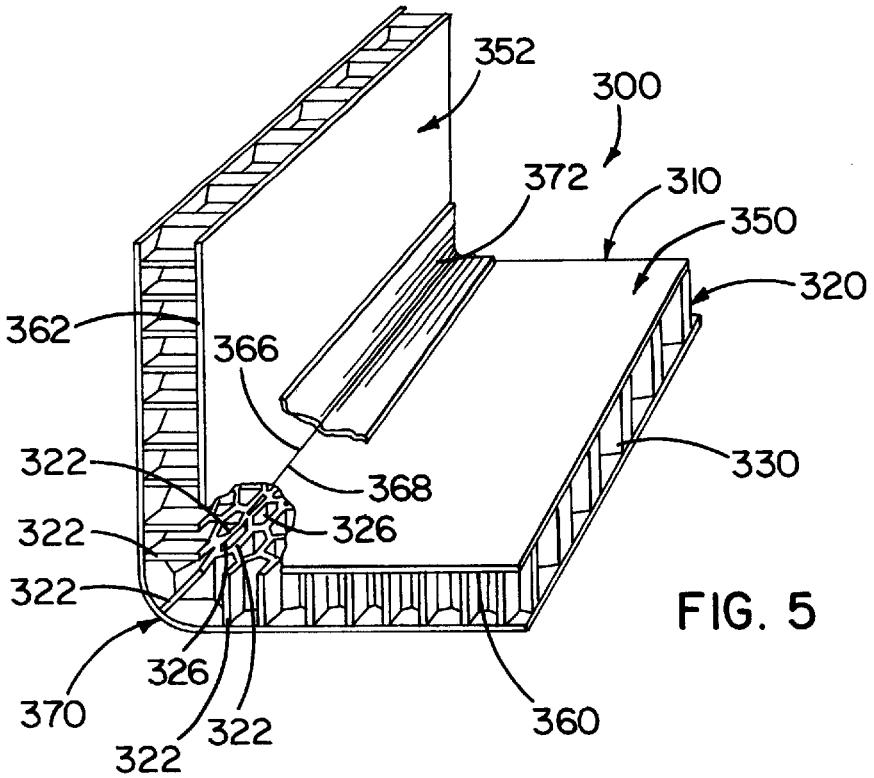
FIG. 5 is a perspective view of the protector of FIG. 4 in its folded position with a strip of tape secured to the interior corner thereof, and a portion of the strip of tape and the top face sheet broken away in the interior corner region of the protector.

Another protector embodiment 300 is depicted in FIGS. 4 and 5. Referring to FIG. 4, protector 300 includes a generally rectangular panel 310 including a core 320 sandwiched between a bottom flat face sheet 330 and first and second top flat face sheets 360 and 362. The core 320 is a honeycomb core comprised of a plurality of abutting and elongate partition walls 322 which extend generally perpendicularly between the bottom face sheet 330 and the first and second top face sheets 360 and 362 respectively. The partition walls 322 form hexagonal cells 324 having opposed bottom (not shown) and top abutting hollow-cell hexagonal faces 326 on opposite sides of the core 320. The bottom face sheet 330 abuts and is adhesively secured to the bottom hollow-cell faces 326 of the core 320 and the first and second top face sheets 360 and 362 abut and are adhesively secured to the top hollow-cell faces 326 of the core 320.

Preferably, the panel 310 is made of the same kraft material and has the same dimensions as the panel 210 of protector 200.

Panel 310 includes a central longitudinal axis 340 and a central transverse axis 342. In the flat position of FIG. 4, the first and second top face sheets 360 and 362 of panel 310 are spaced apart from each other so as to expose a wide central transverse segment 364 of the core 320. The exposed core segment 364 divides the panel 310 into first and second panel portions 350 and 352 respectively. The exposed core segment 364 is disposed between the first and second panel portions and extends the width of the panel 310 centrally along the length of the central transverse axis 342.

The first and second top face sheets 360 and 362 include inner peripheral edges 366 and 368 respectively which are spaced from and parallel to the central transverse axis 342. The width of the exposed core segment 364 and the distance between the inner peripheral edges 366 and 368 of the first and second top face sheets 360 and 362 respectively is about 1.6 times the thickness of the core 320.

The exposed core segment 364, in combination with the central transverse axis 342, defines a hinge about which the first and second panel portions 350 and 352 respectively are folded to form the protector 300 of FIG. 5.

To form the protector 300, the first and second panel portions 350 and 352 are rotated upwardly and inwardly towards each other about the exposed core segment 364 until the first and second panel portions 350 and 352 are positioned generally perpendicularly to each other as shown in FIG. 5 and, more particularly, until the inner peripheral edges 366 and 368 of the first and second top face sheets 360 and 362 respectively abut each other.

In the folded position of FIG. 5, the protector 300 includes an elongate impact resistant and absorbing corner 370 between and unitary with the folded first and second panel portions 350 and 352. Corner 370 defines a portion of the protector 300 where the partition walls 322 of the exposed core segment 364 converge towards each other in the direction of the first and second top face sheets 360 and 362 respectively. In particular, the top peripheral portions of the partition walls 322 are compressed towards each other and the top hexagonal hollow-cell faces 326 of the core 320 are laterally flattened and compressed. Because the core in the corner 370 is not crushed, the core advantageously retains the strength and rigidity characteristics of the core in panel portions 350 and 352 to minimize the risk of damage to an article resulting from an impact in the corner of the protector during shipment. Moreover, because the protector 300 is foldable, it can easily be packaged and shipped in its flat form and then folded by the end user.

To hold the first and second panel portions 350 and 352 in the folded position, an elongate and wide strip of single sided adhesive tape 372 is applied to the interior surface of the corner 370 and the inner peripheral edge portions of the first and second top face sheets 360 and 362. The strip of tape 372 extends the width of the panel 310 centrally along the length of the transverse axis 342.

In lieu of tape 372, a strip of quick-setting adhesive (not shown) can be applied to the surface of the top hollow-cell faces 326 of the exposed core segment 364 just prior to folding the panel 310. Alternatively, a dry or water-based contact adhesive can be applied to the surface of the exposed core segment 364 prior to shipment of the protector 300 to the end user.

Figure 6:
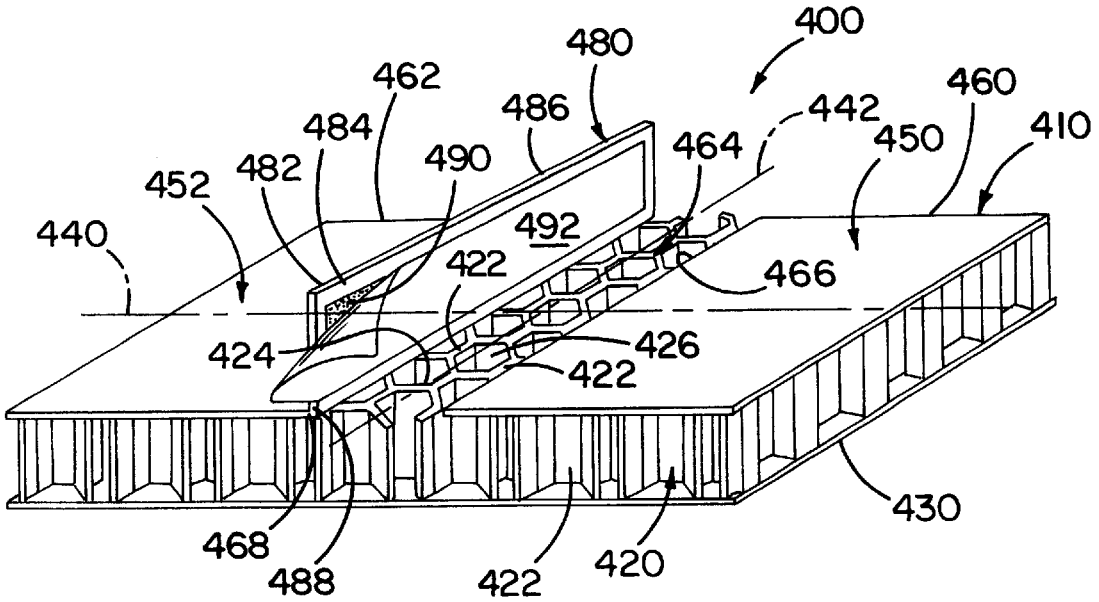
FIG. 6 is a perspective view of a third embodiment of a protector in its flat position.
Figure 7:
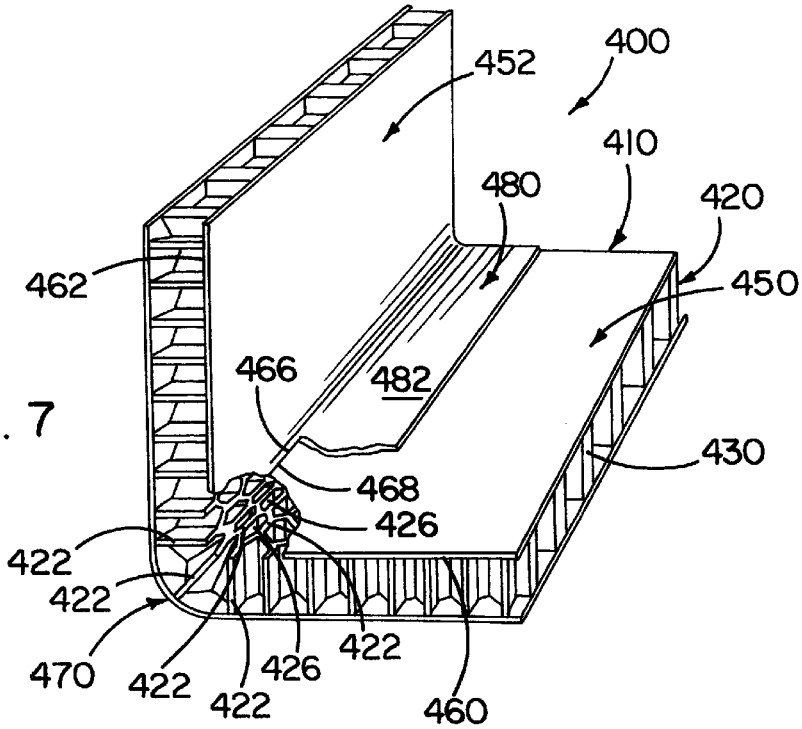
FIG. 7 is a perspective view of the protector of FIG. 6 in its folded position with a portion of the flap and the top face sheet broken away in the interior corner region of the protector.

FIGS. 6 and 7 show another protector embodiment 400 similar in structure to protector 300. Protector 400 differs from protector 300 in that the second panel portion 452 includes a wide and elongate securement flap 480 unitary therewith. Flap 480 extends the width of the panel 410 along the length of the central transverse axis 442 and generally above the exposed core segment 464. Flap 480 includes a top surface 482 and a bottom surface 484. Flap 480 includes a free outer elongate peripheral edge 486 and an opposite parallel inner elongate peripheral edge 488 which is unitary with the inner elongate peripheral edge 468 of the second panel portion 452. The inner elongate peripheral edge 488 of flap 480 is spaced from, and extends parallel to, the central transverse axis 442 of panel 410. The edge 468 of the second panel portion 452 in combination with the unitary edge 488 of the flap 480 define a hinge about which the flap 480 may be rotated. Flap 480, like the exposed core segment 464, has a width which is about 1.6 times the thickness of the core 420.

The bottom surface 484 of the flap 480 includes adhesive means in the form of a strip of double-sided tape 490 with a release paper liner 492. Although not shown, it is understood that the strip of tape could be substituted with any other suitable adhesive means such as a strip of quick-setting adhesive which is applied to the bottom surface 484 of the flap 480 just prior to the panel 410 being folded as described below or a dry or water-based contact adhesive which is applied to the flap prior to shipment of the protector to the end user.

To form the protector 400, the end user initially rotates the first and second panel portions 450 and 452 upwardly and inwardly towards each other about the exposed core segment 464 and the central transverse axis 442 until the first and second panel portions 450 and 452 are positioned generally perpendicularly to each other as shown in FIG. 7 and, more particularly, until the inner peripheral edges 466 and 468 respectively of the first and second panel portions 450 and 452 abut each other.

The release paper liner 492 is then removed from the strip of tape 490 on the flap 480 and the flap 480 is rotated downwardly about its hinge and placed in abutting relationship with the inner peripheral portion of the top surface of the second panel portion 452 to hold the first and second panel portions 450 and 452 and thus the protector 400 in its folded position. According to the invention, the flap dispenses with the need for taping, gluing, or stapling the protector in its folded position. The protector 400 is then ready to be applied to the edge of article 101.

In the folded position of FIG. 7, the protector 400 includes an impact absorbing and resistant corner 470 located between and unitary with the folded first and second panel portions 450 and 452 and co-linear with the central transverse axis 442. The corner 470, like the corners of the previous protector embodiments of this invention, defines a portion of the protector 400 where the partition walls 422 of the exposed core segment 464 converge towards each other in the direction of the top face sheets 460 and 462 and the top peripheral portions of the partition walls 422 are laterally compressed towards each other and the top hexagonal hollow-cell faces 428 of the core 420 in the corner 470 are laterally flattened and compressed. Because only the top face sheet is slitted, the core in the corner 470 advantageously retains the same rigidity and strength characteristics as the panel portions 450 and 452.

Figure 8:
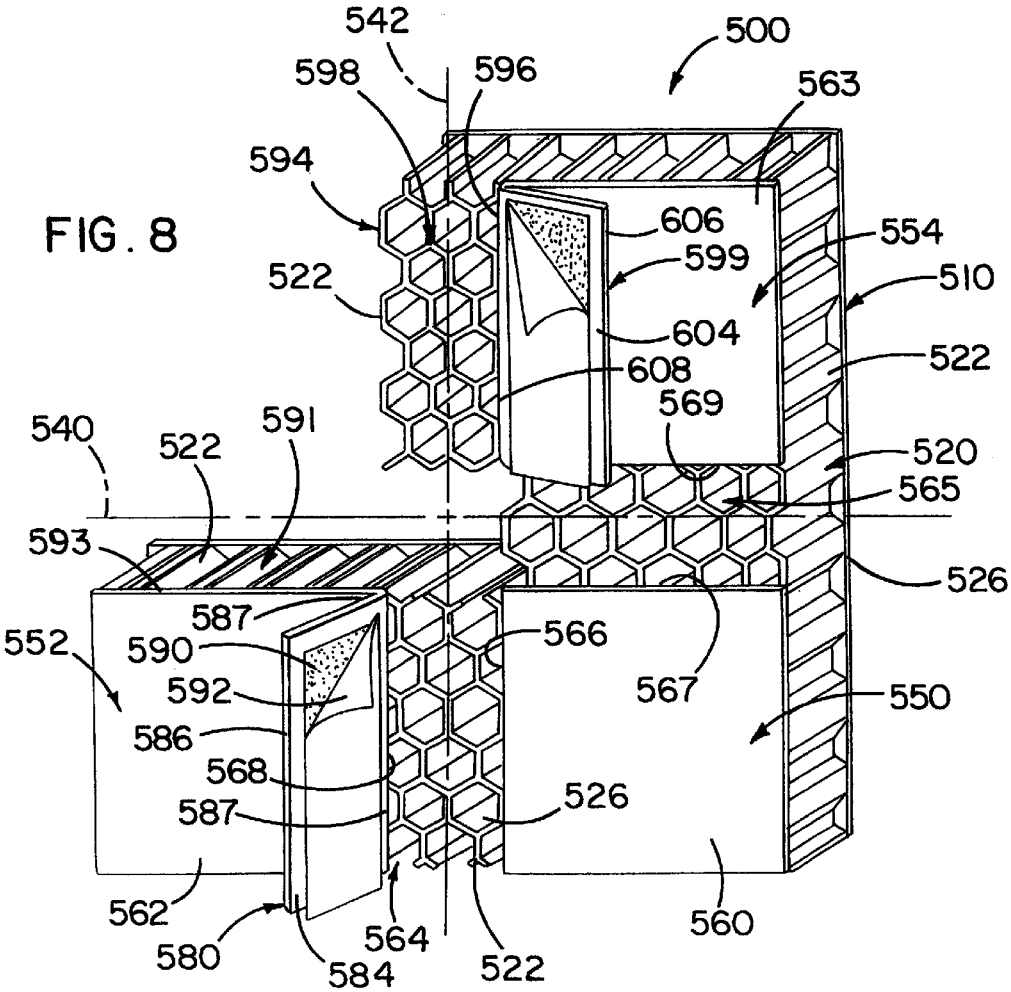
FIG. 8 is a side elevational view of a corner protector embodiment of the protector of FIG. 7 in its flat position.

FIGS. 8 and 9 depict a corner protector embodiment 500 of the edge protector 400.

In the flat position of FIG. 8, the protector 500 comprises a generally L-shaped panel 510 including a core 520 sandwiched between and adhesively secured to a first or bottom face sheet 526 and first, second and third top face sheets 560, 562 and 563 respectively. The core 520 is a honeycomb core similar to the honeycomb core of protector 400.

The panel 510 includes a central longitudinal axis 540 and a central transverse axis 542.

In the flat position of the panel 510 as shown in FIG. 8, the first, second and third top face sheets 560, 562 and 563 are spaced apart from each other so as to expose first and second segments of core 564 and 565 respectively which divide the panel 510 into first, second, and third panel portions 550, 552 and 554 respectively. The first exposed core segment 564 extends longitudinally and centrally along the transverse axis 542 between the first and second panel portions 550 and 552. The second exposed core segment 565 is positioned generally perpendicularly to the first exposed core segment 564 and extends longitudinally and centrally along the longitudinal axis 540 between the first and third panel portions 550 and 554 respectively.

The first panel portion 550 is a generally rectangular member similar in structure to the first panel portion 450 of protector 400 (FIG. 6) and includes a first extended inner peripheral edge, defined by the inner peripheral edge 566 of the first top face sheet 560, which extends parallel to and is offset from the transverse axis 542.

The first panel portion 550 further includes a second extended inner peripheral edge, defined by a second extended inner peripheral edge 567 of the first top face sheet 560, which converges into and is generally perpendicular to the first inner peripheral edge 566 of the first top face sheet 560. The second inner peripheral edge 567 extends parallel to and is offset from the longitudinal axis 540.

The second panel portion 552 is a generally rectangular member similar in structure to the second panel portion 452 of protector 400 (FIG. 6) and includes an extended inner peripheral edge defined by the inner peripheral edge 568 of the second top face sheet 562. The inner peripheral edge 568 is spaced from and extends parallel to the transverse axis 542 and opposite the inner peripheral edge 566 of the top face sheet 560 of the first panel portion 550. The first exposed core segment 564 is disposed between the inner peripheral edges 566 and 568 of the first and second top face sheets 560 and 562 of the first and second panel portions 550 and 552 respectively. The first exposed core segment 564 in combination with the bottom face sheet 530 and the central transverse axis 542 define a hinge about which the first and second panel portions 550 and 552 are folded.

The second panel portion 552 also includes a unitary flap 580 extending outwardly from the inner peripheral edge 568 of the top face sheet 562. The flap 580 extends along the length of the central transverse axis 542 and generally above the first exposed core segment 564. Flap 580 includes a top surface 582 and a bottom surface 584. The flap 580 includes a free outer extended peripheral edge 586 and an opposite and parallel inner extended peripheral edge 587 which is unitary and co-linear with the inner extended peripheral edge 568 of the second top face sheet 562. The inner extended peripheral edge 587 of flap 580 is offset from and parallel to the central transverse axis 542. A strip of double-sided tape 590 including a backing member 592 is adhesively secured to the bottom surface 584 of flap 580.

The second panel portion 552 further includes an inner sidewall 591 defined by the upstanding partition walls 522 of the core 520 which terminates at the top face sheet 562 in an extended inner peripheral edge 593 which converges into and is generally perpendicular to the inner extended peripheral edge 568 of the top face sheet 562. Inner sidewall 591 and edge 593 extend parallel to and offset from the longitudinal axis 540 and co-linearly with the second extended inner peripheral edge 567 of the face sheet 560 of the first panel portion 550.

The third panel portion 554 is a generally rectangular member including a first inner extended peripheral edge defined by a first inner extended peripheral edge 569 of the third top face sheet 563. Inner peripheral edge 569 extends generally parallel to, and is offset from, the central longitudinal axis 540.

Inner peripheral edge 569 extends opposite and is spaced from the second inner peripheral edge 567 of the first panel portion 550. The second exposed core segment 565 extends between the inner peripheral edges 567 and 569 of the first and third top face sheets 560 and 563 respectively. The second exposed core segment 565, in combination with the bottom face sheet 530 and the central longitudinal axis 540, define a hinge about which the first and third panel portions 550 and 554 are folded.

The third panel portion 554 further includes an inner sidewall 594 defined by the upstanding partition walls 522 of the core 520. Inner sidewall 594 extends parallel to and is offset from the central transverse axis 542 and extends co-linearly with the inner peripheral edge 568 of the face sheet 552 of the second panel portion 552.

The third top face sheet 563 includes a second inner extended peripheral edge 596 which converges into and is generally perpendicular to the inner extended peripheral edge 569 thereof. The peripheral edge 596 extends parallel to and is offset from the central transverse axis 542 and extends co-linearly with the first peripheral edge 566 of the top face sheet 560 of first panel portion 550. Peripheral edge 596 is spaced from the inner sidewall 594 of the third panel portion 554 so as to define a third exposed core segment 598 therebetween.

A flap 599 extends unitarily outwardly from the inner peripheral edge 596 of the third top face sheet 563. The flap 599 includes a top surface 602 and a bottom surface 604. The flap 599 also includes a free outer extended peripheral edge 606 and an opposite inner extended peripheral edge 608 which is unitary and co-linear with the inner peripheral edge 596 of the third panel portion 554. The inner peripheral edge 608 of the flap 599 is offset from and parallel to the central transverse axis 542. Although not shown, it is understood that the flap 599 could alternatively extend unitarily outwardly from the inner peripheral edge 569 of the third panel portion 554.

A strip of double-sided tape 610 including a backing member 612 is adhesively secured to the bottom surface 604 of flap 599.

The corner protector 500 is shown in FIG. 9 in its folded and secured position. Corner protector 500 is assembled by initially rotating the first and second panel portions 550 and 552 upwardly and inwardly about the first exposed core segment 564 until the first and second panel portions 550 and 552 are positioned generally perpendicularly to each other and the inner peripheral edge 566 of the first top face sheet 560 of first panel portion 550 is in abutting relationship with the inner peripheral edge 568 of the second top face sheet 562 of the second panel portion 552. The first and second panel portions 550 and 552 are then secured together in their folded position by securing the flap 580 on the second panel portion 552 to the inner peripheral portion of the top surface of the first top face sheet 560 of the first panel portion 550 in the same manner as described earlier with respect to the assembly of protector 400.

The third panel portion 554 is then rotated upwardly and inwardly in the direction of the first panel portion 550 about the second exposed core segment 565 until the first and third panel portions 550 and 554 are positioned generally perpendicularly to each other and the inner peripheral edge 567 of the first top face sheet 560 of the first panel portion 550 is in abutting relationship with the inner peripheral edge 569 of the third top face sheet 563 of the third panel portion 554 and the top hollow-cell faces of the third exposed core segment 598 abut the inner sidewall 591 of second panel portion 552. The flap 599, unitary with the third panel portion 554, is then secured to the inner peripheral portion of the top surface of the second panel portion 552 as shown in FIG. 9.

As with the edge protector 400 depicted in FIG. 7, in the folded position, the corner protector 500 includes an impact resistant and absorbing corner 570 between the folded first and second panel portions 550 and 552 and co-linear with the central transverse axis 542. The corner 570 defines a portion of the protector 500 where the partition walls 522 of the exposed core segment 564 defining the corner 570 converge towards each other in the direction of the top face sheets 560 and 562 and the top peripheral portions of the partition walls 522 are laterally compressed towards each other and the top hexagonal hollow-cell faces 526 of the core 520 are laterally flattened and compressed as shown in FIG. 7 with respect to protector 400.

The corner protector 500 includes a second corner 572 between the folded first and third panel portions 550 and 554 and co-linear with the central longitudinal axis 540 with the same impact resistant and absorbing core characteristics as the corner 570.

Although the corner protector 500 has been described as including a second exposed core segment 565 dividing the first and third panel portions 550 and 554 respectively, the invention contemplates and encompasses corner protector embodiments where cavities in the form of crush slit scores as disclosed in U.S. Pat. No. 5,511,667 to Carder are substituted for the exposed core segment 565. The disclosure therein is incorporated herein by reference. The exposed core segment 565 could also be substituted altogether and replaced with any other suitable cavity or structure which allows for the folding of panel portions.

Figure 11:
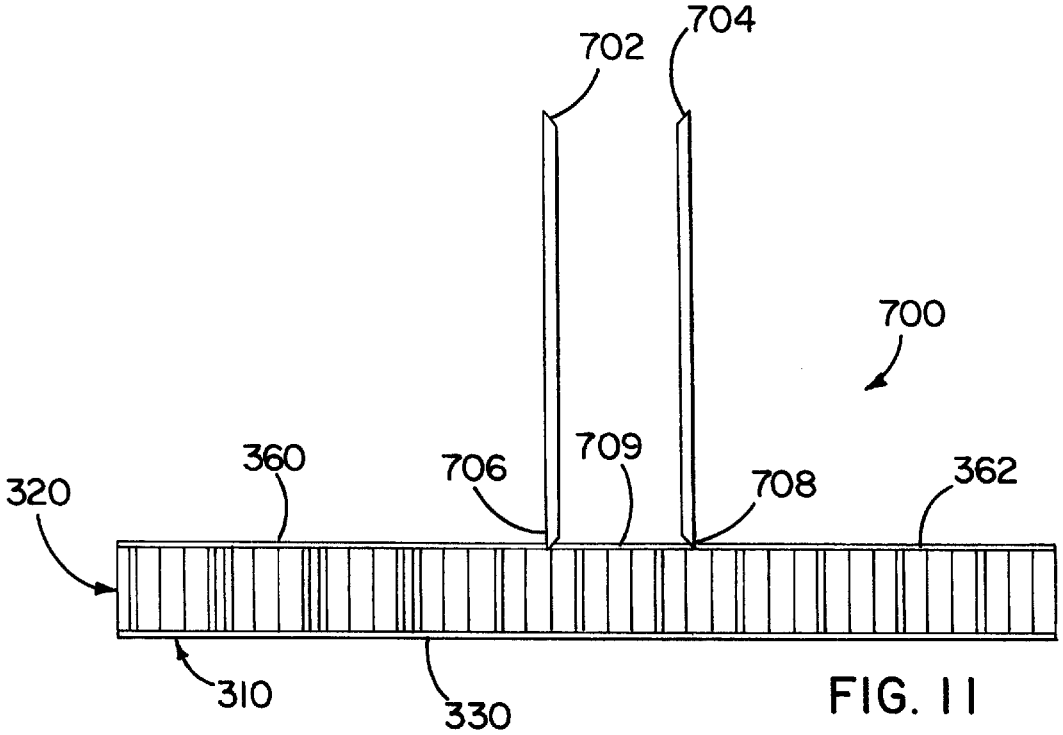
FIG. 11 is a simplified, schematic vertical cross-sectional view of the apparatus of FIG. 10 taken along the line 11—11 in FIG. 10.

Various apparatus and methods for making the protector embodiments of the present invention will now be described with reference to first FIGS. 10 and 11 which show, in schematic form, an apparatus 700 and method for making the protector 300.

Initially, and although not shown, the panel 310 of the protector 300 is preferably formed by providing and conveying an extended length of core 320 through an "in-line" continuous flow panel line where top and bottom face sheets are adhesively secured to the top and bottom hollow-cell faces of the core 320 to form the panel 310.

The resulting panel 310 is then conveyed through the panel line past the apparatus 700 which includes slitting means such as rotary saws or circular knife slitters 702 and 704 positioned with respect to the panel 310 in a spaced apart side-by-side relationship to cut first and second spaced-apart parallel slits 706 and 708 in the top face sheet to define the inner peripheral edges 366 and 368 respectively of the first and second top face sheets 360 and 362 of the panel 310.

After the slitters 702 and 704 have cut through the top face sheet, removal means in the form of a vacuum 716 or the like is then used to remove the face sheet strip 709 which has been separated from the core to define the centrally disposed exposed core segment 364 in the panel 310. It is preferred that this operation be conducted before the glue is dry.

In accordance with this method, and to make the separation and removal of the face sheet segment easier, it is desirable that the face sheet segment, which is cut and removed from the core to form the exposed core segment 364, not be adhesively secured to the core beneath the face sheet segment.

Although not shown, it is understood that this can be accomplished by damming the glue spreader, which spreads the glue onto the top and bottom hollow-cell faces of the core prior to the top and bottom face sheets being secured thereto, in the area of the core segment overlying the face sheet segment to be removed.

Alternatively, and in lieu of damming the glue spreader, the core segment underlying the face sheet segment to be removed can be punched at predetermined spaced intervals to create dimples or hourglass-shaped inner recesses into which glue is not received when the glue is spread onto the hollow-cell faces thereof. As a result, a hollow-cell face area is created with a smaller adhesive core surface area making it easier to separate the face sheet from the core.

Alternatively, the top face sheet can be fed into the panel line in two spaced-apart segments thus eliminating the need to cut out any face sheet segment from the core. As a still further alternative, a die press can be used.

The apparatus 700 could also be used in slightly modified form to make the protector embodiments 200 and 400.

To make the protector 200, the apparatus 700 would include a plurality of circular knife slitters positioned in side-by-side relationship to cut the plurality of spaced-apart slits 264 in the central transverse segment 262 of the top face sheet 260 of the panel 210.

To make the protector 400 including the flap 480, the apparatus 700 would comprise a single circular knife slitter for cutting a single slit in the top face sheet of the panel 410. A separator in the form of a scrapper or the like would then be used to separate the face sheet segment comprising the flap 480 from the surface of the core 420. The width of the face sheet segment which is separated from the core 420 would be dependent upon the width of the separator 710.

In an alternative method not depicted herein, panel 310 can be made "off-line" by adhesively securing a strip of core 320 on a bottom face sheet 330 and then applying first and second top face sheets 360 and 362 to the top hollow-cell faces 328 of the core 320 in spaced apart relationship to form a panel 310 including first and second panel portions 350 and 352 separated by a exposed central core segment 364. This "off-line" method eliminates several manufacturing steps such as the need to slit and remove a face sheet segment to create the exposed core segment and the glue damming or core dimple forming steps. It also reduces the amount of paper material which is wasted during the manufacturing operation.

The method of making a corner protector with first, second and third panel portions is similar to the "off-line" method described herein for making a protector with first and second panel portions except that it would include the step of applying a third top face sheet to the top hollow cell faces of the core in spaced apart relationship from the first top face sheet so as to expose a second core segment between the first and third top face sheets.

Figure 12:
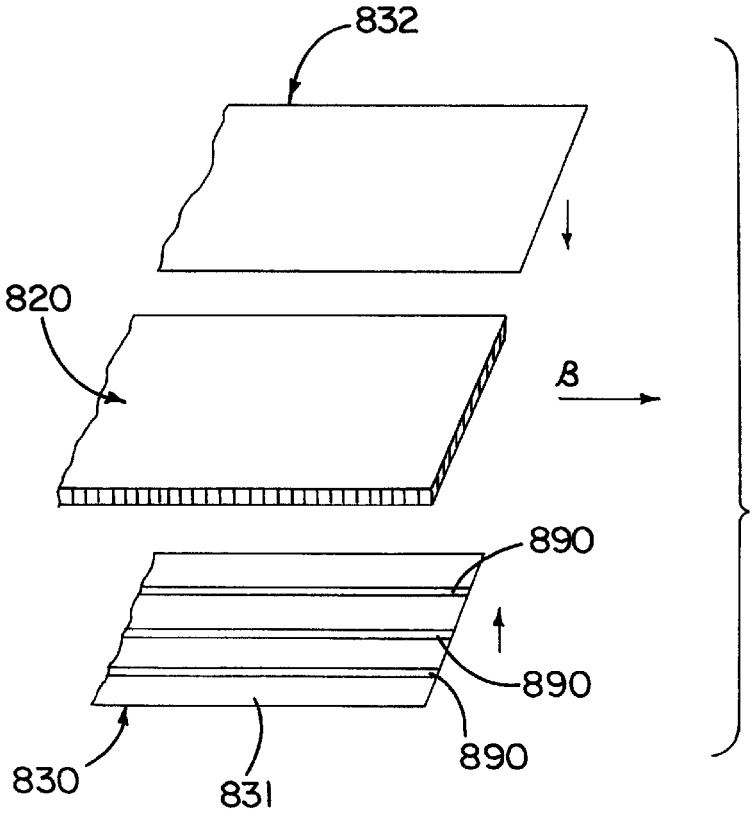
FIGS. 12–14 are simplified, schematic views depicting a method of making the protector of FIG. 6.
Figure 13:
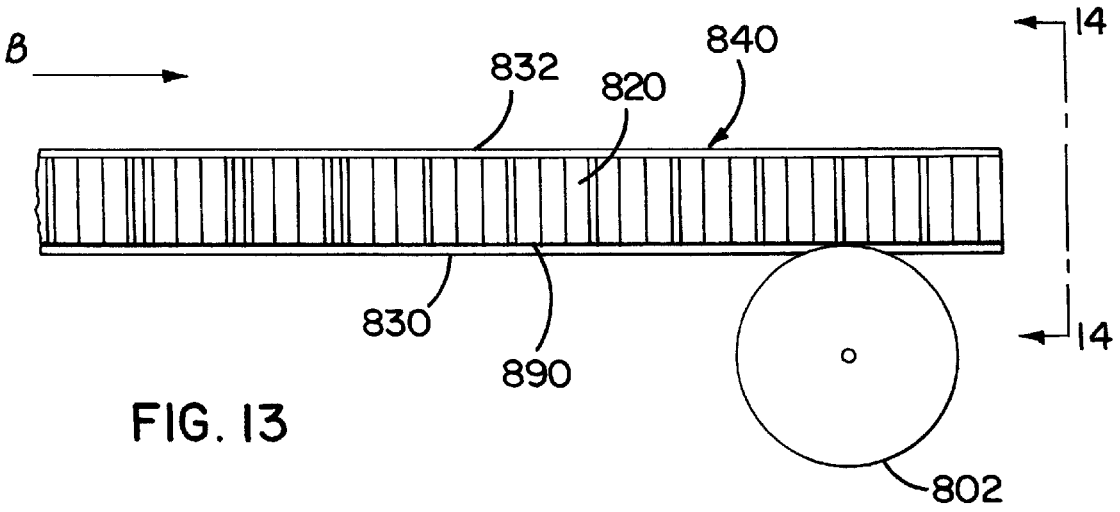
Figure 14:
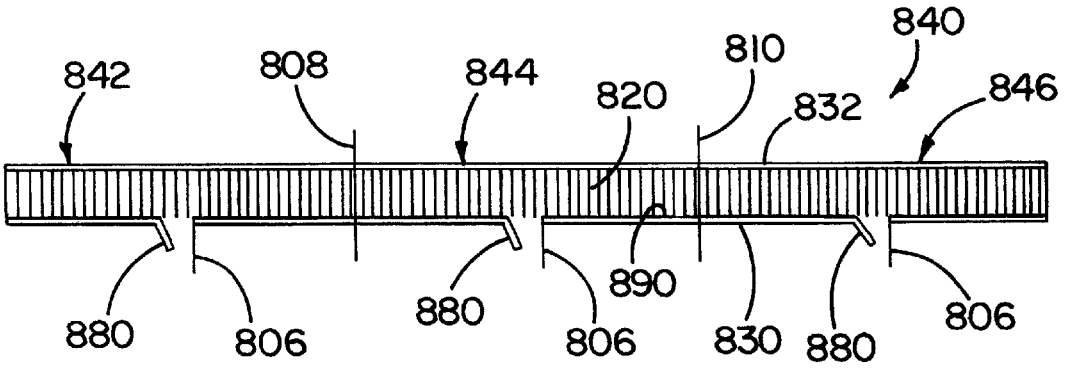

FIGS. 12–14 depict a method for making a plurality of the protectors 400 depicted in FIG. 6 in an "in-line" continuous flow panel line (not shown). Referring to FIG. 12, the method initially comprises the steps of providing an elongate continuous web of honeycomb core 820 and first and second elongate continuous sheets of web material comprising bottom and top face sheets 830 and 832 respectively. FIG. 12 shows only a broken segment of the continuous core 820 and sheets 830 and 832. It is understood, of course, that the core 820 is supplied to the panel line in extended continuous form and that the sheets 830 and 832 are supplied and unwound from rolls.

Next, the core 820 and face sheets 830 and 832 respectively are moved generally horizontally in the direction of arrow A along a work path through the panel line. At a selected station along the work path, one or more continuous elongate strips of adhesive, such as double-sided tape 890 or the like, are applied to spaced-apart strips of the continuous bottom face sheet 830 as the bottom face sheet 830 is moved through the panel line. In particular, the double-sided tape 890 is applied along the length of the bottom face sheet 830 and to the inner surface 831 thereof with the release paper liner (not shown) of the tape 890 facing away from the inner surface 831. The tape 890 preferably has a width which is about 1.6 times the thickness of the core 820.

Once the strips of tape 890 have been applied to the bottom face sheet 830, the bottom and top face sheets 830 and 832 respectively are secured to the bottom and top faces of the honeycomb core 820 at another station along the panel line to form a continuous elongate honeycomb panel 840 as shown in FIG. 13 which includes a honeycomb core 820, bottom and top face sheets 830 and 832 respectively and strips of double-sided tape 890 between the inner surface of the bottom face sheet 830 and the bottom hollow-cell face of the core 820.

The panel 840 is moved further along the work path to another station where a plurality of rotary saws or circular knife slitters 802, 804 and 806 are positioned (FIGS. 13 and 14) for slitting through the bottom face sheet 430 and the tape 490.

The panel 840 is moved still further along the work path to yet another station where the strips of tape 890 respectively which have been slitted are separated from the core 820 to form a panel 840 with spaced-apart and parallel flaps 880, each having a width of about 1.6 times the thickness of the core 820.

The separation of the sheet strips from the core is made easier because the glue on the core will not ordinarily adhere to the silicone type slippery surface of the release paper liner of the tape 490. However, and as described earlier, the glue spreaders on the panel line can additionally be damned to make the separation of the bottom face sheet 830 from the core 820 easier. Alternatively, the longitudinal honeycomb core segments underlying the strips of the bottom face sheet 830 to be separated can be dimpled as described earlier to make the separation of the bottom face sheet strips from the core easier.

After the flaps 880 have been formed, the panel 840 is moved still further along the panel to yet another station where another set of slitters 808 and 810 (FIG. 14) are positioned between the flaps 880 in spaced-apart relationship for cutting the panel 840 into a plurality of smaller elongate and continuous panels 842, 844 and 846 each including a flap 880.

Finally, and although not shown, the panels 842, 844 and 846 are moved still further through the panel line to a final station where each of the smaller elongate panels are cut at spaced intervals in a direction transverse to the direction in which the panels move through the panel line to form a plurality of protectors 400 as shown in FIGS. 6 and 7 each including a flap 480.

The foregoing is illustrative of the principles of the invention for a foldable edge and corner protector where fold lines are formed without crushing or slitting the honeycomb core so as to provide a foldable protector including corners having a honeycomb core structure with the same rigidity and strength characteristics as the core structure of the other surfaces of the protector. However, since numerous modifications and changes will readily occur to those skilled in the art, it is not desired to limit the invention to the exact construction and operation shown and described. Accordingly, all suitable modifications and equivalents may be resorted to while still falling within the scope of the invention.

What is claimed is:

1. A protector comprising a panel foldable between a flat position and a folded position, the panel including a honeycomb core having a plurality of abutting partition walls forming a plurality of abutting cells defining a plurality of abutting top and bottom hollow cell faces respectively, a bottom face sheet secured over and abutting the bottom hollow cell faces of the honeycomb core, and a top face sheet secured over and abutting the top hollow cell faces of the honeycomb core, the top face sheet including a slitted segment defining a hinge about which the panel is folded, wherein only the top face sheet is slitted leaving the honeycomb core intact in the flat position, the panel defining a corner portion in the folded position where the partition walls of the honeycomb core converge towards each other in the direction of the top face sheet and the top hollow cell faces of the honeycomb core are laterally compressed, in the folded position at the corner portion the partition walls are not vertically deformed.

2. The protector of claim 1 wherein the slitted segment of the top face sheet is defined by first and second top face sheet portions spaced apart from each other in the flat position so as to expose a segment of the honeycomb core and the top hollow cell faces thereof, each of the first and second top face sheet portions having a respective inner extended peripheral edge, the edges being disposed in abutting relationship in the folded position.

3. The protector of claim 2 further comprising a strip of adhesive tape applied to the interior of the corner portion and covering the inner peripheral edges of the first and second top face sheet portions.

4. The protector of claim 2 further comprising a flap unitary with the inner peripheral edge of the second top face sheet portion, the flap abutting and being adhesively secured to the outer surface of the first top face sheet portion in the folded position.

5. The protector of claim 1 wherein the slitted segment of the top face sheet is defined by a plurality of spaced-apart and parallel slits in the top face sheet.

6. The protector of claim 5 wherein the panel includes a longitudinal axis and a transverse axis, the plurality of slits extending centrally on the panel in spaced-apart and parallel relationship along the transverse axis.

7. The protector of claim 5 wherein the panel is foldable about the segment to form a corner, the core comprising a honeycomb core including a plurality of abutting partition walls forming a plurality of abutting cells defining a plurality of abutting hollow cell faces on opposed sides of the core respectively, the face sheet being positioned over and abuttingly secured to the hollow cell faces on one of the sides of the honeycomb core whereby, in the folded position, the partition walls of the honeycomb core in the region of the corner converge towards the face sheet and the hollow cell faces abutting the face sheet are compressed.

8. The protector of claim 1 wherein the slitted segment is removable from the top face sheet so as to expose a segment of the honeycomb core and the top hollow cell faces thereof, the exposed segment of the honeycomb core defining the hinge about which the panel is folded.

9. A protector comprising a panel foldable between a flat position and a folded position, the panel including a honeycomb core having a plurality of abutting partition walls forming a plurality of cells defining a plurality of abutting hollow cell faces on opposite sides of the honeycomb core respectively, a bottom face sheet secured over and abutting the plurality of hollow cell faces on one side of the honeycomb core, and a first and second top face sheets secured over and abutting the plurality of hollow cell faces on the opposite side of the honeycomb core, the plurality of abutting partition walls of the honeycomb core extend generally perpendicular between the bottom face sheet and the first and second top face sheets, the first and second top face sheets being spaced from each other in the flat position so as to expose a segment of the honeycomb core and the hollow cell faces thereof, the exposed segment of the honeycomb core being located between the first and second top face sheets, wherein the honeycomb core of the exposed segment is intact in the flat position with the plurality of abutting partition walls of the exposed segment of the honeycomb core remaining generally perpendicular to the first and second top face sheets and bottom face sheet, the exposed segment of the honeycomb core defining a hinge about which the panel is folded, in the folded position at the hinge the partition walls of the exposed segment being generally vertically undeformed.

10. The protector of claim 9 wherein each of the first and second top face sheets includes an inner extended peripheral edge, the peripheral edges of the first and second top face sheets being spaced from each other in the flat position and abutted to each other in the folded position and the partition walls of the exposed segment of the honeycomb core converging towards the first and second top face sheets and the hollow cell faces of the exposed segment of the honeycomb core being compressed in the folded position.

11. The protector of claim 10 further comprising a strip of adhesive tape applied over the abutting peripheral edges of the first and second top face sheets when the panel is folded.

12. The protector of claim 10 wherein the distance between the inner peripheral edges of the first and second top face sheets is about 1.6 times the thickness of the honeycomb core.

13. The protector of claim 9 further comprising adhesive means applied to the hollow cell faces of the exposed segment of the honeycomb core for securing the panel in the folded position.

14. The protector of claim 9 wherein the second top face sheet includes a flap extending unitarily outwardly from an inner peripheral edge thereof, the flap abutting and being adhesively secured to the top of the first top face sheet to secure the panel in the folded position.

15. The protector of claim 14 wherein the flap includes an extended peripheral edge unitary with the inner peripheral edge of the second top face sheet and a second free extended peripheral edge opposite the first extended peripheral edge.

16. The protector of claim 9 wherein the second top face sheet includes a flap extending unitarily outwardly from an inner peripheral edge thereof, the flap abutting and being secured to the top of the first top face sheet in the folded position, the flap including a bottom surface with adhesive means thereon for adhesively securing the panel in the folded position.

17. The protector of claim 16 wherein the adhesive means comprises a strip of double-sided tape.

18. The protector of claim 16 wherein the adhesive means comprises a strip of glue.

19. The protector of claim 16 wherein the width of the flap is about 1.6 times the thickness of the honeycomb core.

20. The protector of claim 9 wherein the width of the exposed core segment is about 1.6 times the thickness of the honeycomb core.

21. A protector comprising a panel including a core sandwiched between a bottom face sheet and first and second top face sheets, the first and second top face sheets being spaced apart from each other so as to expose a segment of core therebetween about which the panel is folded, the second top face sheet including an inner extended peripheral edge and a flap extending unitarily outwardly therefrom, the flap including adhesive means such that when the panel is folded about the exposed core segment, the flap is secured to the surface of the first top face sheet to hold the panel folded.

22. The protector of claim 21 wherein the flap includes an extended peripheral edge unitary with the inner peripheral edge of the second top face sheet and an opposite free extended peripheral edge.

23. The protector of claim 21 wherein the width of the flap is about 1.6 times the thickness of the honeycomb core.

24. The protector of claim 21 wherein the width of the exposed core segment is about 1.6 times the thickness of the core.

25. The protector of claim 21 wherein the adhesive means comprises a strip of double-sided tape applied to the bottom surface of the flap.

26. The protector of claim 21 wherein the adhesive means comprises a strip of glue applied to the bottom surface of the flap.

27. The protector of claim 21 wherein the top face sheet includes a third top face sheet spaced apart from the first top face sheet so as to expose a second segment of core between the first and third top face sheet portions, the panel being folded about the second exposed core segment, the exposed core segments converging and being positioned generally perpendicularly to each other, the third top face sheet including an inner peripheral edge and a flap extending unitarily outwardly therefrom and including adhesive means such that, when the panel is folded about the second exposed core segment, the flap on the third top face sheet is secured to the surface of one of the first or second top face sheets to hold the panel folded.

28. The protector of claim 27 wherein the inner peripheral edge of the third top face sheet is parallel to and spaced from the inner peripheral edge of the first top face sheet when the panel is in a flat position, the flap on the third top face sheet being secured to the top surface of the first top face sheet when the panel is folded.

29. The protector of claim 27 wherein the inner peripheral edge of the third top face sheet is perpendicular to the inner peripheral edge of the first top face sheet in the flat position, the flap being secured to the surface of the second top face sheet when the panel is folded.

30. A protector comprising a panel including a honeycomb core having a plurality of abutting partition walls forming a plurality of abutting cells defining a plurality of abutting top and bottom hollow cell faces respectively, a bottom face sheet secured over and abutting the bottom hollow cell faces of the honeycomb core, and a top face sheet secured over and abutting the top hollow cell faces of the honeycomb core, the top face sheet including a slitted segment defining a hinge about which the panel is folded, the slitted segment is defined by first and second top face sheet portions spaced apart from each other when the panel is in a flat position so as to expose a segment of the honeycomb core and the top hollow cell faces thereof, each of the first and second top face sheet portions having a respective inner extended peripheral edge, the edges being disposed in abutting relationship such that first and second top face sheet portions do not overlap when the panel is folded, the folded panel defining a comer portion where the partition walls of the honeycomb core converge towards each other in the direction of the top face sheet and the top hollow cell faces of the honeycomb core are laterally compressed.

31. The protector of claim 30 further comprising a strip of adhesive tape applied to the interior of the corner portion of the folded panel and covering the inner peripheral edges of the first and second top face sheet portions.

32. The protector of claim 30 further comprising a flap unitary with the inner peripheral edge of the second top face sheet portion, the flap abutting and being adhesively secured to the outer surface of the first top face sheet portion when the panel is folded.

33. The protector of claim 30 wherein the slitted segment of the top face sheet is defined by a plurality of spaced-apart and parallel slits in the top face sheet when the panel is in a flat position.

34. The protector of claim 30 wherein the slitted segment is removable from the top face sheet when the panel is in a flat position so as to expose a segment of the honeycomb core and hollow cell faces thereof, the exposed segment of the honeycomb core defining the hinge about which the panel is folded.

35. A protector comprising a panel including a core sandwiched between a bottom face sheet and a top face sheet, the top face sheet including a slitted segment defining a first and a second top face sheet portion, the second top face sheet portion including an inner extended peripheral edge and a flap extending unitarily outwardly therefrom, the flap including adhesive means such that when the panel is folded about the slitted segment, the flap is secured to the surface of the first top face sheet portion to hold the panel folded.

36. The protector of claim 35 further including a crush score along the slitted segment.

37. A protector comprising a panel foldable between a flat position and a folded position, the panel including a honeycomb core having a plurality of abutting partition walls forming a plurality of abutting cells defining a plurality of abutting top and bottom hollow cell faces respectively, a bottom face sheet secured over and abutting the bottom hollow cell faces of the honeycomb core, and a top face sheet secured over and abutting the top hollow cell faces of the honeycomb core, the top face sheet including a slitted segment defining a hinge about which the panel is folded, the panel defining a comer portion in the folded position where the partition walls of the honeycomb core converge towards each other in the direction of the top face sheet and the top hollow cell faces of the honeycomb core are laterally compressed, the top face sheet is defined by first and second top face sheet portions spaced apart from each other in the flat position so as to expose a segment of the honeycomb core and the top hollow cell faces thereof, each of the first and second top face sheet portions having a respective inner extended peripheral edge, the edges being disposed in abutting relationship in the folded position, the second top face portion includes a flap unitary with the inner peripheral edge of the second top face portion, the flap abutting the outer surface of the first top face sheet portion in the folded position.

38. The protector of claim 37 wherein the flap is adhesively secured to the outer surface of the first top face sheet portion in the folded position.

39. An impact resistant corner protector comprising:

a honeycomb panel having a plurality of abutting partition walls forming a plurality of abutting cells defining a plurality of abutting top and bottom hollow cell faces respectively;

a bottom face sheet secured over and abutting said bottom hollow cell faces of said honeycomb core; and a top face sheet secured over and abutting said top hollow cell faces of the honeycomb core, said top face sheet including a slitted segment defining a first panel portion and a second panel portion, said first panel portion converging at an angle with said second panel portion to form a comer, at said corner said top hollow cell faces of said honeycomb core are laterally compressed and said partition walls are not vertically deformed.

* * * * *